United States Patent [19]

Adams et al.

[11] Patent Number: 4,818,422

[45] Date of Patent: Apr. 4, 1989

[54] FABRIC SOFTENING DETERSIVE ARTICLE

[75] Inventors: Richard P. Adams, Kendall Park; Richard J. Holland, Trenton; Patricia A. Bodak-Cumming, Edison, all of N.J.

[73] Assignee: Colgate-Palmolive Co., Piscataway, N.J.

[21] Appl. No.: 98,345

[22] Filed: Sep. 17, 1987

[51] Int. Cl.[4] ..... D06M 13/12

[52] U.S. Cl. ..... 252/8.8; 252/90

[58] Field of Search ..... 252/8.8, 90

[56] References Cited

U.S. PATENT DOCUMENTS

| | | | |
|---|---|---|---|
| 3,095,373 | 6/1963 | Blomfield | 252/8.8 |
| 4,108,600 | 8/1978 | Wong | 8/137 |
| 4,113,630 | 9/1978 | Hagner | 252/8.6 |
| 4,118,525 | 10/1978 | Jones | 427/242 |
| 4,298,480 | 11/1981 | Wixon | 252/8.75 |
| 4,427,410 | 1/1984 | Chirash | 8/137 |
| 4,441,881 | 4/1984 | Ruppert | 8/137 |
| 4,571,303 | 2/1986 | Ciallella | 252/174.23 |
| 4,659,496 | 4/1987 | Klemm | 252/90 |

*Primary Examiner*—John F. Niebling
*Assistant Examiner*—Isabelle Rodriguez
*Attorney, Agent, or Firm*—Bernard Lieberman; Murray M. Grill

[57] ABSTRACT

A fabric softening and detersive article, preferably in the form of a flexible non-woven fabric pouch, is permeable to passage of a contained fabric softening detergent composition into wash water in an automatic washing machine. The presence of a relatively minor proportion of anionic surfactant in the fabric softening detergent composition (which also contains nonionic detergent, cationic fabric softener and builder for the nonionic detergent) promotes passage of all or substantially all of the fabric softening detergent composition and its components through the pouch walls so that little or no residue remains therein after completion of the washing operation even when the wash water is cold, e.g., about 20° C. Thus, efficiencies of washing and fabric softening are improved and no objectionable residue is left in the pouch, which could otherwise lead to consumer rejection of such a product.

Also within the invention is a liquid detergent composition comprising a mutual neutral solution of anionic detergent and nonionic detergent, preferably with some water present as a co-solvent, which is useful in manufacturing the detergent compositions of the present articles, a process for manufacturing the invented articles and washing methods in which such articles are utilized.

23 Claims, 2 Drawing Sheets

FABRIC SOFTENING DETERSIVE ARTICLE

This application relates to a fabric softening detersive article. More particularly, it relates to such an article which includes a particulate fabric softening detergent composition in a water permeable, water insoluble container, such as a flexible pouch of a fabric made from synthetic organic polymeric plastic fibers or filaments. Components of such composition are transportable to the wash water through the walls of the pouch during automatic washing machine washing of laundry, when such article is employed for such purpose, so that the pouch is emptied or substantially emptied during such use, leaving little or no residue behind. The invention also relates to liquid detergent compositions, comprising nonionic detergent and anionic surfactant, useful in making the low residue compositions of the present articles. Additionally,it includes a process for manufacturing the described articles, as well as a method for washing and softening laundry by use of such articles.

Prior to the present invention it was known to package detergents in water soluble or water permeable containers for direct additions to wash waters in automatic washing machines. By employment of such articles, containing pre-measured charges of detergent compositions, any requirement for the consumer to measure out detergent powder from a box was obviated. The pouch or envelope of detergent composition, correctly pre-measured for normal household automatic washing machine use, could conveniently be removed from a carton holding a plurality of such pouches and could easily be charged to a washing machine, without the need to pour detergent composition powder from a box, with possible attendant spilling, dusting and inhaling of powder. Also, the pre-measured charge of detergent composition obviates erroneous measuring so that most efficient washing, and fabric softening, when a fabric softening agent is also present, are readily obtainable. However, some disadvantages attend the employment of soluble and permeable pouches and other containers that open in wash water, and of other "transparent" containers for detergent compositions, especially for those compositions which also include cationic fabric softener.

Water soluble containers are often subject to breakage on handling, and can leak contents before use, as can those pouches made from water insoluble fabrics, which are designated to open when they are added to wash water in an automatic washing machine. Also, pouches made from water insoluble fabrics, which may retain substantial amounts of fabric softener therein-,after washing operations can allow such softener, in relatively large quantities, to contact laundry being dried in a hot air dryer, so that "quat-spotting" may occur, in which deposits of cationic fabric softener are localized, causing greasy spotting of the laundry and frequently resulting in yellowing of the laundry at such locations. When permeable pouches are employed, which allow a more gradual transport of the composition components to the wash water, sometimes the composition is not completely discharged from the pouch during the normal operation of the washing machine, and this problem is often compounded if the washing machine is set for gentle agitation and when the wash water temperature is low. Residue problems are also more severe when the detergent composition is a built or heavy duty nonionic detergent composition, such as one in which the builders include carbonate and in which the fabric softening agent is quaternary ammonium halide softener, like that of the distearyl di-lower alkyl ammonium halide type.

The residue problem that was referred to above attended the employment of built nonionic detergent compositions in water insoluble, water permeable containers, such as heat sealed pouches of non-woven polyester and other synthetic organic polymeric fibers when a fabric softening proportion of cationc fabric softener was present in the pouch, and the residue was greater and more objectionable when the detergent was nonionic and the builder(s) included sodium carbonate. In various washing machine runs, utilizing such fabric softening detersive articles, especially when the washing machine's gentle cycle was employed and the wash water temperature was relatively cold, e.g., about 20° C., objectionable percentages, e.g., over 10%, of fabric softening detergent composition could be in the pouch after the completion of washing. Efforts to overcome the residue problem by redesigning the pouch or envelope had been made by others, but the present inventors tried a different approach, changing the composition to be dispensed from the article. Thus, whereas others had suggested employing a polyvinyl alcohol seal for the pouch (that would open in wash water), or water soluble particles dispersed in the pouch surface material to create passageways through the pouch walls when the article was dropped into the wash water, the present invention avoids production problems and premature openings of such seals before use, and utilizes more conventional (and reproducible) pouch material, which will not leak contents prematurely.

Applicants' surprisingly effective solution to the residue problem includes incorporation in the detergent composition of a relatively small or minor proportion of anionic surface active agent (surfactant), such as triethanolammonium dodecylbenzene sulfonate (hereinafter referred to by its more common name, triethanolamine dodecylbenzene sulfonate, or TEALDBS. Such material apparently helps to evacuate the pouch of its contents, and thereby provides more effective washing and softening of the laundry, and increases consumer satisfaction with the product.

Why the presence of the anionic surfactant in the composition in the permeable pouch promotes transporting of the contents through the pouch walls is not completely understood. It has been theorized that the anionic surfactant preferentially reacts with the cationic fabric softener, thereby preventing reaction of the fabric softener with alkaline builder salt, which could produce objectionable residue and could prevent much of the fabric softener from reaching the wash water, and softening the laundry. One might have expected that such transporting could have been inhibited by the formation of the lipophilic reaction product of the anionic and cationic materials but apparently such reaction product does not seriously interfere with the solution, emulsification or dispersion of the pouch contents. The transport promoting action of the anionic surfactant must be more than a mere wetting or surface tension decreasing action because also present in the detergent compositon in the pouch is a significantly greater proportion of nonionic detergent, which also possesses wetting characteristics. A theory that has been advanced to explain the action of the anionic surfactant in the present articles is applicable to the non-phosphate detergent compositions, in which the builder systems include carbonate, bicarbonate and zeolite builders. In the manufacture of the invented detergent composition for use in the present articles the anionic and nonionic detergents, which are applied in common solution to base beads, enter the pores of the base beads, which inhibits premature reaction of the anionic and cationic surfactants. Yet, the anionic-nonionic surfactant combination is readily removed from the beads of builder by wash water entering the pouch, whereby preferential reaction of the anionic surfactant with the fabric softener can take place, preventing reaction of the fabric softener with the builder, which could produce a lumpy residue that would remain in the pouch. Such theory does not explain why articles of this invention which include sodium tripolyphosphate as a builder may also include anionic surfactant in flake or powder form, post-added to the base beads, as the fabric softener powder is post-added, without premature reaction or residue remaining in the pouch and without significant reduction in fabric softening and detergency, but such tripolyphosphate builder is not as reactive with cationic fabric softener as is carbonate and appears to be more readily soluble in wash water when dispensed from water permeable pouches or packets.

In accordance with this invention, a fabric softening and detersive article for use in an automatic washing machine to wash and soften laundry, is a fabric softening particulate built laundry detergent composition in a water permeable, water insoluble container, through a permeable wall of which container components of the fabric softening particulate detergent composition, in aqueous solution, emulsion and/or dispersion form, are transportable to wash water in the automatic washing machine during a washing cycle of such machine, so that the laundry in the wash water may be washed and softened thereby, and in which article the fabric softening detergent composition comprises a detersive proportion of nonionic detergent, a building proportion of builder for the nonionic detergent, a fabric softening proportion of fabric softening cationic compound and a transport promoting proportion of anionic surface active agent (surfactant), which proportion of anionic surfactant is less than the proportions of the nonionic detergent and of the fabric softening cationic compound, and which anionic surfactant solubilizes, emulsifies and/or disperses component(s) of the fabric softening detergent composition, including the fabric softening cationic compound, in the permeable container so that substantially all of such composition and such compound passes out of the container and into the wash water during washing of laundry in the washing machine.

Relevant prior art known to the applicants includes patents on single use packets of detergent composition and bleaches, such as U.S. Pat. No. 4,220,153, 4,286,016, 4,348,293, 4,374,747, 4,410,441 and 4,567,675; British Pat. Nos. 1,578,951, and 1,587,650; and European Pat. No. 0,184,261. Fabric softening detergent compositions have been described in many U.S. patents, among which U.S. Pat. Nos. 4,582,615, 4,609,473, and 4,659,496 may be mentioned. Detergent compositions comprising anionic and cationic surfactants are described in U.S. Pat. No. 4,000,077 and permeable pouches containing complexes of anionic and cationic surfactants are disclosed and claimed in U.S. patent application Ser. No. 916,069 (Thomas and Kern), filed Oct. 6, 1986. However, such specifications, alone or in combination do not anticipate the present invention nor make it obvious because there is no indication therein that a minor proportion of anionic surfactant, such as triethanolamine dodecylbenzene sulfonate, would significantly improve the evacuation of applicants' fabric softening detergent composition from the permeable pouch during machine washing of laundry, which improved evacuation results in improved cleaning, brightening and softening of laundry, prevents quat spotting, and avoids negative consumer attitudes toward the product (for not all being used up).

The fabric softening and detersive article of the present invention include two main components, a permeable dispensing container and a composition in it. Although built detergent compositions containing anionic and nonionic detergent have been known and have been described in technical literature, and envelopes or packets for detergents, of synthetic and natural organic polymeric fibrous materials, were known and described, before the present invention there had not been any articles of the present type, in which a minor proportion of anionic surfactant or detergent significantly improved evacuation of a contained fabric softening detergent composition from its dispensing container during use. Such improved effect depends on the described composition being present in the water insoluble, permeable container and the unexpected beneficial effect obtained helps to establish that the novel articles of this invention are unobvious from the prior art.

The invention will be readily understood from the description thereof herein, taken in conjunction with the accompanying drawing, in which.

Figure 1:
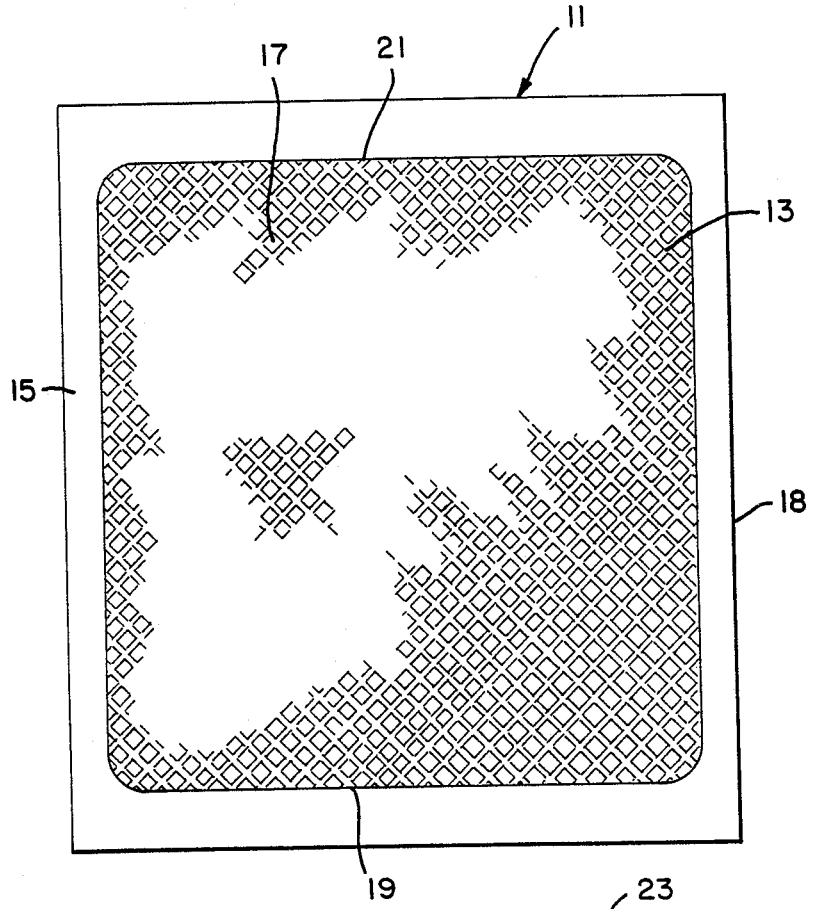
FIG. 1 is a xerographic top plan view of an actual article of the present invention.

In FIG. 1 pre-weighed fabric softening detergent article 11, suitable for addition to an automatic washing machine to wash an average load of laundry therein, comprises two sheets of non-woven polyester fabric, an upper sheet 13 and a lower sheet (not visible), which are heat sealed together along the four sides thereof, represented by numeral 15. The polyester fabric 13 is fabricated with diamond-shaped patterns, such as that illustrated at 17 (accentuated), which pattern extends over both surfaces of the sheet but which is flattened out by heat sealing along the sides thereof, at 15. Particulate fabric softening detergent composition (not visible) is contained in pouch 18, with that numeral designating the permeable covering of article 11 about the particulate contents thereof.

Article 11 is of a flat pillow shape, with the thickness thereof usually being in the range of 0.01 to 0.2 times the width of the portion of the pouch containing particulate detergent (that portion "inside" the heat sealed article sides). Ends of the pouch are illustrated in the shaded portion designated by numeral 19 and in unshaded portion 21, which portions, as illustrated, indicate the thickness of the article.

Figure 2:
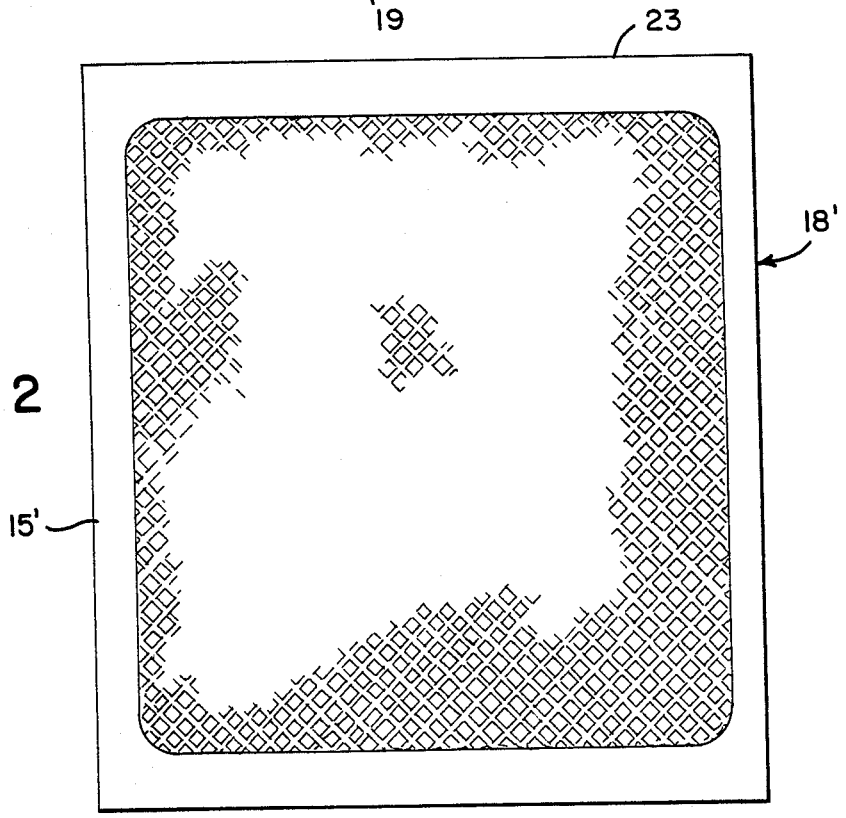
FIG. 2 is a top plan view of a pouch of the present invention, sealed on three sides and open on one side, before being filled with fabric softening detergent composition.

In FIG. 2 open pouch 18' is shown, with three heat sealed sides, represented by numeral 15', and with one open end 23. Particulate fabric softening detergent composition may be added to such pouch through open end 23, after which such end may be heat sealed to produce article 21 (shown in FIG. 1).

Figure 3:
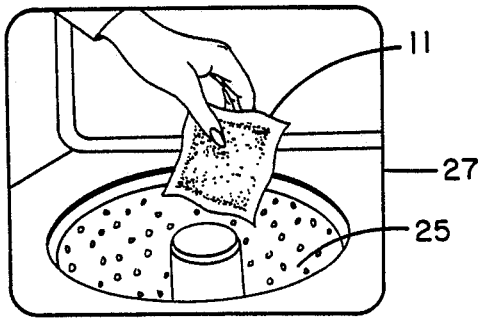
FIG. 3 is a perspective view of an article of this invention being added to the wash tub of an automatic washing machine.

In FIG. 3 there is shown article 11 of this invention being added to wash water (not shown) in tub 25 of top loading washing machine 27. Such addition is made before clothing and other items to be laundered are added to the wash water.

Figure 4:
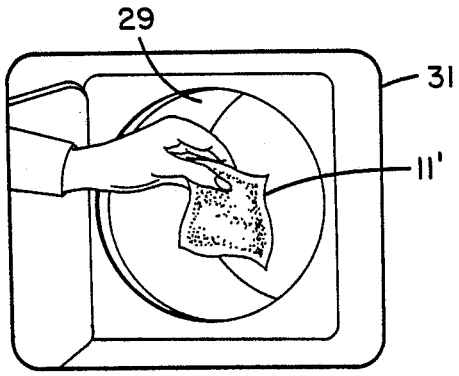
FIG. 4 is a perspective view of the empty pouch of the present invention being added to the laundry dryer after completion of treatment of the laundry.

In FIG. 4 the empty pouch or depleted fabric softening and detersive article, designated 11', is shown being added to drum 29 of side loading automatic laundry dryer 31. The pouch at this stage contains little or none of its original contents because of the effectiveness of the anionic surfactant in promoting transport of such contents through the permeable walls of the pouch and into the wash water. Thus, the depleted article may be discarded after completion of the washing and softening of the laundry in automatic washing machine 27 or it may be dried with the laundry in automatic dryer 31, and then may be discarded. Normally the remains of the article will be dried with the laundry because it adds little drying load on the dryer, it is desirable to avoid having to separate the wet pouch from the washed laundry, and a dry pouch is more convenient to dispose of than a wet one. In instances in which another fabric softening detergent composition than that of this invention is utilized, and does not evacuate its dispensing container completely during the washing cycle, any cationic fabric softener remaining in the pouch can become fused due to the heat of the dryer and, in liquid state, can flow through the pouch onto laundry being dried. While such transport through the pouch wall in the dryer may improve fabric softening (because only part of the desired such effect was obtained in the washing machine) it can also result in "quat-spotting" of the laundry being dried, in which greasy spots of cationic softener are deposited on the laundry. Such spots, in addition to being objectionable because of their greasy nature, tend to yellow or otherwise discolor, too, and therefore are to be avoided whenever possible. Of course, such quat spotting is minimized when the articles of the present invention are employed in accordance with the procedures described.

The invented fabric softening detergent composition comprises a detersive proportion of nonionic detergent, a building proportion of builder for the nonionic detergent, a fabric softening proportion of fabric softening cationic compound and a transport promoting proportion of anionic surface active agent, which proportion of anionic surfactant is less than the proportions of the nonionic detergent and of the fabric softening cationic compound. Such anionic surfactant promotes the transport of fabric softening cationic compound and other components of the composition, especially normally water soluble alkaline builders, such as sodium carbonate and other alkaline builders mentioned herein, through a water insoluble, water permeable wall or a plurality of such walls of the container, which is preferably of a flexible fabric, such as non-woven polyester, nylon or rayon fibers (which may be mixed with each other or with other synthetic or natural fibers). It is considered that the anionic surfactant helps to dissolve, emulsify and/or disperse components of the present compositions but it is understood that its main function is to promote transport thereof through the container wall(s), which is obtainable by preventing detrimenta insolubilizing of some or all of such components (which, in effect, promotes dissolving, emulsifying and/or dispersing of them).

The nonionic detergent of the present compositions is any suitable nonionic detergent, which class is well known in the art, with many members thereof being described in the various annual issues of *Detergents and Emulsifiers*, by John W. McCutcheon, for example, the 1973 Annual. Such volumes give chemical formulas and trade names for virtually all commercial nonionic detergents marketed in the United States, and substantially all of such detergents can be employed in the present compositions. However, it is highly preferred that such nonionic detergent be a condensation product of ethylene oxide and higher fatty alcohol (although instead of the higher fatty alcohol, higher fatty acids and alkyl phenols may also be employed). The higher fatty moieties, such as the alcohol of such condensation products, will normally be linear, of 10 to 18 carbon atoms, preferably of 10 to 16 carbon atoms, more preferably of 12 to 15 carbon atoms and sometimes most preferably of 12 to 14 carbon atoms. Because such fatty alcohols are normally available commercially only as mixtures the numbers of carbon atoms given are necessarily averages but in some instances the ranges of numbers of carbon atoms may be actual limits for the alcohols employed and for the corresponding alkyls.

The ethylene oxide (EtO) content of the nonionic detergent will normally be in the range of 3 to 15 moles of EtO per mole of higher fatty alcohol, although sometimes as much as 20 moles of EtO may be present. Preferably such proportion will be 3 to 10 moles and more preferably it will be 6 to 7 moles, e.g., 6.5 or 7 moles,per mole of higher fatty alcohol (and per mole of nonionic detergent). As with the higher fatty alcohol, the polyethoxylate limits given are also limits on the averages of the numbers of EtO groups present in the condensation product. Both broad range ethoxylates and narrow range ethoxylates (BRE's and NRE's) may be employed, with the difference between them being in the "spread" of numbers of ethoxylate groups, which average within the ranges given. For example, NRE's which average 5 to 10 EtO groups per mole in the nonionic detergent will have at least 70% of the EtO in polyethoxy groups of 4 to 12 moles of EtO and will preferably have over 85% of the EtO in such range. BRE nonionic detergents have a broader range of ethoxy contents than NRE's, often with a spread of 1 to 15 moles of EtO when the EtO content is in the 5 to 10 range (average) Examples of the BRE nonionic detergents include those sold by Shell Chemical Company under the trademark Neodol®, including Neodol 25-7, Neodol 23-6.5 and Neodol 25-3. Supplies of NRE nonionic detergents have been obtained from Shell Development Company, which identifies such materials as 23-7P and 23-7Z, and from Union Carbide Corporation, which identifies such a product as Tergitol 24-L-60N. The present NRE's and "corresponding" BRE's are described in U.S. patent application Ser. No. 084,524 (Holland and Buda), filed Aug. 10, 1987, which recites advantages of the NRE's.

The builder for the nonionic detergent may be any suitable water soluble or water insoluble builder, either inorganic or organic, providing that it is useful as a builder for the particular nonionic detergent or mixture of nonionic detergents that may be employed. Such builders are well known to those of skill in the detergent art and include: alkali metal phosphates, such as alkali metal polyphosphates and pyrophosphates, including alkali metal tripolyphosphate; alkali metal silicates, including those of $Na_2O:SiO_2$ ratio in the range of 1:1.6 to 1:3.0, preferably 1:2.0 to 1:2.8, and more preferably 1:2.35 or 1:2.4; alkali metal carbonate; alkali metal bicarbonate; alkali metal sesquicarbonate (which may be considered to be a mixture of alkali metal carbonate and alkali metal bicarbonate); alkali metal borate, e.g., borax; alkali metal citrate; alkali metal gluconate; alkali metal nitrilotriacetate; zeolites, preferably hydrated zeolites, such as hydrated Zeolite A, Zeolite X and Zeolite Y; and mixtures of individual builders within one of such types of builders, and of different types. Preferably the builders will be sodium salts and will also be inorganic. A highly preferred water soluble builder composition, based principally on phosphate builder, includes tripolyphosphate and silicate builders, with the silicate being in minor proportion. Of non-phosphate builder systems, that comprising carbonate, bicarbonate and zeolite is preferred.

The various builders need no further description except, perhaps, for the zeolite. Such builder is water insoluble and is preferably hydrated, as with from 4 to 36% of water of hydration, preferably 5 to 30%, more preferably 10 or 15 to 25%, and most preferably, 17 to 22%, e.g., about 20%. The zeolite is normally in a finely divided state, with particle sizes normally in the range of No's. 100 to 400, preferably 140 to 325, U.S. Sieve Series, but it may be agglomerated to builder bead size, too. Its ultimate particle diameter will be in the range of 0.01 to 20 microns, more preferably 0.01 to 15 microns, e.g., 3 to 12 microns, and most preferably 0.01 to 8 microns, mean particle size, e.g., 3 to 7 microns, if crystalling and 0.01 to 0.1 micron, if amorphous.

The fabric softening cationic compound may be any suitable such compound,such as an imidazolinium salt or a quaternary ammonium salt. Both types of fabric softeners are described in U.S. Pat. No. 4,000,077. Of the two types of softeners the quaternary ammonium salts are preferred, and of these the quaternary ammonium halides, such as the quaternary ammonium chlorides, are more preferred.

The quaternary ammonium salt fabric softening compound is preferably of the formula

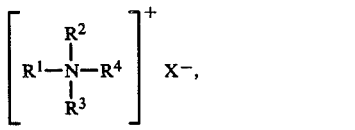

wherein $R^1$ and $R^2$ are lower alkyls of 1 to 3 carbon atoms, $R^3$ is higher alkyl of 10 to 20 carbon atoms, $R^4$ is alkyl of 1 to 20 carbon atoms, and $X^-$ is a salt forming anion, preferably either chlorine or bromine, and more preferably chlorine. In such quaternary salts $R^1$ and $R^2$ are preferably the same lower alkyl and $R^3$ and $R^4$ are preferably the same higher alkyl, with the most preferred fabric softener being dimethyl distearyl ammonium chloride. The useful quaternary ammonium halides include those wherein the higher alkyls are tallowalkyl or hydrogenated tallowalkyl, cetyl, myristyl and/or lauryl, and wherein the lower alkyls are methyl and/or ethyl.

The transport promoting anionic surfactant may be any suitable such surfactant, such as are described in the McCutcheon's publications previously mentioned but of these those which are preferred are the water soluble alkali metal or alkanolamine salts of higher alkylbenzene sulfonate, higher fatty alcohol sulfate or higher fatty alcohol polyethoxy sulfate, or mixtures thereof. Preferably, such salts are sodium or triethanolammonium (triethanolamine) salts, and of these the triethanolamine salts are even more preferred. Of the triethanolamine and other suitable salts, that of higher alkylbenzene sulfonic acid, e.g., triethanolamine linear dodecylbenzene sulfonate, is most preferred. However, the corresponding alkali metal salts and mixtures of alkali metal (preferably sodium) and alkanolamine (preferably triethanolamine) salts may be employed, as may be mixtures of diakanolamine or monoalkanolamine and trialkanolamine salts. For the preferred lipophilic groups of the anionic surfactants the higher alkyl will be of 12 to 16 carbon atoms, the higher fatty alcohol moiety will be of 12 to 18 carbon atoms, the polyethoxy will be of 3 to 15 ethoxy groups and the alkanolamine will be mono-, di- or tri-lower alkanolamine of 1 to 3 carbon atoms, preferably being of ethanolamine, e.g., triethanolamine. Thus, the most preferred anionic surfactant is triethanolamine higher alkylbenzene sulfonate wherein the higher alkyl is of 12 to 14 carbon atoms, e.g., linear dodecyl.

Various other components may be present in the detergent composition to improve its properties and in some cases, to act as diluents or fillers. Among the suitable fillers the one most preferred is sodium sulfate. Among the adjuvants there may be listed soil release promoting agents, such as the polyethylene terephthalate-polyoxyethylene terephthalate (PET-POET) soil release promoting copolymers, of molecular weights in the range of 19,000 to 43,000, with the molecular weight of the polyoxyethylene thereof being in the range of about 2,500 to 5,000, with the molar ratio of PET:-POET units being in the range of 2:1 to 6:1, and with the proportion of ethylene oxide to phthalic moiety in the copolymer being in the range of 20:1 to 30:1. Enzymes may be present to promote cleaning of hard to remove stains from the laundry. Of the enzymes the most useful in laundering operations are the proteolytic and amylolytic enzymes, preferably in mixture. Polyacrylates, such as sodium polyacrylate of molecular weight in the range of 1,000 to 3,000, are useful for their dispersing properties and also function as stabilizers for the PET-POET copolymer, which stabilizing action is of importance with respect to obtaining most effective promoting of removal of soil from laundry, especially laundry items made of polyester fabrics. Flow promoting agents, such as hydrated synthetic calcium silicate, often sold under the trademark Microcel C, may be employed in relatively small proportions for their mentioned function. Additional components of the fabric softening detergent composition include: fluorescent brighteners, such as the stilbene brighteners; perfumes; colorants, including dyes and water dispersible pigments; and water.

The water permeable, water insoluble container for the particulate fabric softening detergent composition of the present articles may be any suitable such container which allows the intrusion of water and the transport of the contained composition through permeable walls thereof into wash water However, although it is contemplated that form retaining containers, such as those resembling perforated polyethylene or polypropylene bottles, or polyurethane sponges may also be employed, the most preferred form of container is a flexible pouch of thin material, preferably of fabric, and more preferably of non-woven fabric Such fabric may be made from fibers or filaments of various materials, either synthetic or natural, but it is preferred that it be substantially or entirely of synthetic organic polymeric fibers. Of such fibers those of polyesters, nylons and rayons are more preferable, with polyester fibers being considered to be the best. Such fibrous materials can readily be made of desired permeability by modifying manufacturing methods, fiber size and fabric weight.

The preferred non-woven sheets used to make the pouches for the present articles will normally be of a thickness in the range of 0.1 to 1 mm., a weight in the range of 35 to 45 g./sq. m. and air permeability in the range of 1 to 3 cu. m./min./sq. cm. Air permeability is related to fluid permeability of a fabric being employed and also relates to ease of transport through such fabric of contents of a pouch. One of the other variables that affects the permeability and the pre-use integrity of the pouch (non-sifting of contents through the walls thereof) is the thickness of the fibers or filaments. It has been found that preferred fibers are of 2 to 4 denier, e.g., about 3 denier. The pouch material which is preferred is that manufactured by Kendall Corporation, which company also manufactures and fills the pouches, to make the desired articles. Their fabrics, used for pouch materials, are described by their specification numbers, which include 149-026, SP 284, SP 284.1, SP 289 and SP 289.1.

The fabric softening detersive article described above will be of such size, weight, pouch material, composition and composition particle sizes as to satisfactorily wash laundry in automatic washing machines and to empty substantially all, over 90%, preferably over 95%, more preferably over 99%, and most preferably 100%, of the fabric softening detergent composition from the permeable container through permeable walls thereof, into the wash water in an automatic washing machine. Desirably, the amount of detergent composition transported into the wash water will be that amount which satisfactorily cleans and softens a washing machine load of dirty laundry. However, the size and/or weight of the invented article may be adjusted so that a plurality of such articles furnishes the requisite amount of such detergent composition. Ideally, about 50 grams of detergent composition will be present in the invented article but, depending on the the proportions of components in such composition, such weight may be in the range of 10 to 200 grams, and is preferably in the range of 30 to 100 grams.

The concentration of the detergent composition in the wash water, after complete evacuation of the fabric softening detergent composition from the article, will ideally be about 0.075%, with corresponding broad and preferred ranges of 0.015 to 0.3% and 0.045 to 0.15%, respectively, (considering that the volume of wash water in the automatic washing machine tub is about 64 liters). Ideally, the concentration of nonionic detergent in the wash water will be 0.012%, the ideal concentration of fabric softening compound will be 0.006% and the proportion of builder salt will be about 0.04% for both the phosphate and non-phosphate formulas. The percentage of transport promoting anionic detergent will ideally be about 0.003%. Ranges of concentrations of such components may be calculated from ranges of concentrations of the total composition, based on the preferred individual concentrations given above.

The size of the invented article will be that which is convenient to be hand held. It has been determined that such an article which is square and measures about 10 cm. by 10 cm. (measuring the external surfaces through which, after heat sealing, composition components may be transported to the wash water) is ideal but other sizes and shapes may also be employed. Thus, the total permeable surface area, measured externally, may be in the range of 100 to 500 sq. cm. and ideally, will measure about 200 sq. cm. (2×10 cm.×10 cm.). For such a product the thickness of the article, after filling of the pouch, will be about 1 cm. but thicknesses within the range of 0.5 to 4 cm., preferably 0.8 to 2 cm., are feasible, often with corresponding adjustments of the composition bulk density and of the permeability characteristics of the pouch material. Such bulk density will normally be comparatively high, such as from 0.4 to 0.8 g./cu. cm., preferably 0.5 to 0.7 g./cu. cm.

With respect to pouch permeability, the weave of the woven fabrics and the deposit of fibrous materials of the nonwoven fabrics should be tight enough to prevent undesirable sifting of particulate material out of the article before use and yet should be sufficiently loose to permit transport of liquids and undissolved fine particles of the contained composition through the permeable material of the pouch or container wall. It has been found that with the preferred pouch materials of this invention, utilizing the preferred compositions, containing anionic transport promoting surfactant, the pouch is essentially completely emptied in normal cold water (21° C.) washing machine washing, even with gentle agitation, and minimal sifting through the pouch results, even upon vigorous shaking before addition of the article to the wash water. Thus, on such shaking, less than 0.1% of the composition is lost and in normal packaging, transportation and storage before use none escapes from the pouch. On the other hand, if the anionic surfactant is omitted from the contained composition more than 20% of the composition will often remain in the pouch at the end of a gentle automatic washing machine washing cycle at 21° C. To obtain these desirable results with the invented articles it is considered that openings in the pouch fabric should be held to less than 0.1 mm. in width or diameter, and should be large enough to allow the passage through them of aqueous liquids and finely divided particles, such as particles of insoluble components of the contained detergent composition, e.g., zeolites, the ultimate sizes of which were previously mentioned.

The pouch material is desirably flexible, as woven and non-woven fabrics almost invariably are, because during the operation of the washing machine flexible containers or pouches, by frequently changing shape, can help to promote passage of fluids through their walls, which aids in evacuating the contained composition from such containers. Experimental work has established that the better the agitation the more complete the emptying of the pouch will be during a washing operation, and the use of a flexible pouch with a detergent composition containing anionic surfactant as a transport promoter favors complete evacuation and transport of the contained composition through the pouch walls during wishing, even at agitation conditions that are less then optimum (normal or gentle washing cycle, at low temperatures and with a heavier load of laundry than is desirable).

The proportions of the various components of the present compositions that are of significance with respect to operativeness of the invention will be chosen to produce the desired result, good detergency, good fabric softening, substantially complete evacuation of the pouch, no quat spotting or yellowing of the laundry, and no significant adverse effects of the quaternary ammonium halide softening agent on any fluorescent brightener that may also be present in the compositions. The content of nonionic detergent in the detergent composition will normally be in the range of 8 to 40%, preferably being 12 to 25%, more preferably being 14 to 20% and most preferably being 16% or about 16%. The content of builder(s) will normally be in the range of 30 to 70%, preferably being 40 to 65%. When the builder is a "phosphate builder system" the portion of sodium tripolyphosphate therein will preferably be in the range of 40 to 60% and the proportion of sodium silicate will be in the range of 3 to 8%. Most preferably such contents will be at or about 48% and 5%, respectively. When the builder system is non-phosphate the proportions of sodium carbonate, sodium bicarbonate and hydrated zeolite (as its anhydride) will be in the ranges of 15 to 35%, 5 to 20% and 10 to 35% respectively, and more preferably will be at or about 24%, 10% and 23%, respectively. In the phosphate detergent composition the phosphate or tripolyphosphate will be from 5 to 20 times the weight of the silicate and in the non-phosphate detergent composition the weight of sodium carbonate will be from 0.7 to 1.5 times the weight of zeolite (anhydrous basis) and the weight of sodium bicarbonate will be from 0.3 to 0.7 times the weight of sodium carbonate.

The fabric softening cationic compound will normally be from 0.5 to 15% of the fabric softening detergent composition, preferably being 7 to 10% thereof and more preferably being at or about 8.5%. The transport promoting anionic surfactant will usually be present in the detergent composition in an amount within the range of 1 to 8% thereof, preferably being 3 to 6% and more preferably being at or about 4%. The moisture contents of the detergent compositions may vary, depending on whether the composition is a phosphate or a non-phosphate formula. The phosphate-containing compositions are designed to contain 8 to 14% of moisture, preferably 9 to 12% thereof and more preferably about 11%, whereas the non-phosphate formulas will usually contain 5 to 10%, preferably 6 to 9% and more preferably about 7.7 or 8%. The balances of the detergent compositions will usually be of adjuvants and/or fillers, the more important of which have already been mentioned. The soil release promoting PET-POET copolymer content will normally be in the range of 1 to 5%, preferably 2 to 4%, and more preferably will be about 3% and the proportion of sodium polyacrylate stabilizer for the PET-POET copolymer is normally in the range of 0.25 to 1.25%, preferably being 0.5 to 1%, and more preferably being about 0.7 or 0.75%. The enzymes content of the detergent composition will normally be in the range of 0.5 to 3%, preferably 0.5 to 2%, and more preferably about 1%, and the Microcel C or hydrated synthetic calcium silicate flow promoting powder content will be from 0.3 to 3%, preferably 0.5 to 2%, and more preferably will be about 0.8%. Ranges of contents of fluorescent brightener and perfume are normally 0.2 to 2%, preferably 0.3 to 1% and more preferably about 0.5%, and 0.3 to 2%, preferably 0.3 to 1% and more preferably about 0.4%, respectively. The percentages and ranges of percentages given above are all on a final product "as is" basis except for the zeolite, which has already been discussed. When in this specification, and in the claims, composition components, such as nonionic detergent, anionic surfactant, fabric softening compound and builded, are mentioned in the singular but are not specifically identified, it is to be understood that more than one of such is also encompassed by such description, and percentages given relate to such individual components or to mixtures thereof.

In manufacturing the fabric softening detergent compositions employed in making the articles of this invention conventional spray drying procedures may be substantially followed, with some modification. Thus, base beads, usually of inorganic builder, are made by mixing together an aqueous crutcher mix of such builder or builder mixture, usually at a solids content in the range of 40 or 50 to 75%, at a temperature in the 40°–75° C. range, and spray drying it in a conventional spray tower at a drying gas temperature in the range of 250° to 450° C. to produce substantially globular beads of particle sizes in the range of 10 to 100, preferably 10 to 60, U.S. Sieve Series. Fluorescent brightener, such as stilbene brightener, and any other heat stable adjuvants and fillers, may be incorporated in the crutcher mix, to be dried with the builder(s). If such spray drying results in larger and smaller particles also being produced they may be screened or air classified to the desired range or to another such range considered as acceptable for the purpose intended. Those dried beads, after cooling, then have nonionic detergent in liquid state absorbed therein, by spraying the desired nonionic liquid detergent, either a BRE or an NRE detergent, onto moving surfaces of the beads. A processing advantage of the use of NRE's is that they liquefy nearer to room temperature than the BRE's, and accordingly, require less heating for liquefaction. Also, it is considered that they penetrate better into the interiors of the spray dried base beads at a given temperature, which can improve processing and can result in freer flowing product. In a preferred aspect of the manufacturing process, utilized in making the compositions of this invention, instead of spraying onto the base beads liquid state nonionic detergent only, there is sprayed onto such beads a relatively low temperature solution of the transport promoting anionic surfactant in the nonionic detergent. While the liquid detergent solution may be at a more elevated temperature, such as up to 45°, 50° or 60° C. in some instances, it is preferred to keep its temperature as low as feasible, normally in the 30° to 40° C. range, e.g., about 32° C., at which temperature the anionic surfactant and the nonionic detergent will often be mutually soluble, especially when NRE and in presence of a suitable cosolvent. In such solution the proportion of anionic surfactant to the conionic detergent will be in the range of 1:6 to 1:2, preferably being in the range of 1:5 to 1:3 and more preferably being about 1:4. Of the operative cosolvents water is preferred. On a final built detergent composition basis there will usually be 3 to 6 parts of anionic surfactant per 12 to 25 parts of nonionic detergent in such liquid detergent. Ideally, the proportions of nonionic detergent, anionic surfactant and water in such a solution will be about 16 parts of nonionic detergent, 4 parts of anionic surfactant and 2.7 parts of water, all on a final products basis, too, as percentages. Normally such solutions will comprise 60 to 80 parts of nonionic detergent, 10 to 25 parts of anionic surfactant and 5 to 20 parts of water, on a solution basis. Other solvents may be substituted for the water, when that is considered to be desirable, and in some instances the water may be omitted, retaining the relative proportions of the nonionic detergent and anionic surfactant. Conveniently, the anionic surfactant will sometimes be supplied as a water solution or paste, which can be used as obtained. The solution of the detergent and surfactant is preferably sprayed onto tumbling base beads in a suitable mixing device, such as an inclined drum, with the solution temperature most preferably being at about 32° C. (90° F.). After application of the solution to the base beads perfume may be similarly sprayed onto them and in some cases such spraying may occur at approximately the same time (but usually to different surfaces of the tumbling beads).

The described application of nonionic detergent and anionic surfactant (very preferably triethanolamine dodecylbenzene sulfonate) to the base beads is an important process step in the manufacture of the described non-phosphate fabric softening detergent compositions of the present articles. Although such process is also useful in manufacturing the phosphate-built compositions it has been found that such compositions are often operative in the present articles and are evacuated from them during washing in an automatic washing machine even when the anionic surfactant, even in solid state as a sodium salt, is post-applied (as flakes or powder) to the detergent composition already containing nonionic detergent absorbed into the base beads. In such compositions it appears that residue and transport problems are not as serious and therefore the special effects of the co-absorbed anionic surfactant and nonionic detergent in inhibiting undesirable reaction of alkaline builder and cationic fabric softener often may not be necessary (although such action may still be advantageous).

After absorption of the anionic surfactant, nonionic detergent cosolvent (if present) and perfume by the base beads there are then mixed together such resulting particulate sub-composition, enzyme mixture, soil release promoting agent and fabric softening cationic compound, all in powdered form. The particle sizes of such powdered components will be such that they do not sift objectionably through the "pores" of the pouch or container and usually such oowders will be of No. 200, U.S. Sieve Series, or larger when feasible. When finer powders are employed, such as those of particle sizes less than No. 200, dusting and sifting of such powders may be prevented by their adherence to larger beads, which also can improve flow characteristics of the composition, which can assist in speeding filling of the pouches (which is effected by automatic machinery).

The soil release promoting PET-POET copolymer will be added to and mixed with the detergent composition beads in a previously prepared blend with sodium polyacrylate, in desired proportions of such components in the composition, as was previously indicated. The fabric softening compound may be mixed with the other components alone or, as is preferable, in a previously prepared mixture with Microcel C and a wetting agent or emulsifier (preferably a polyethoxylated higher fatty alcohol of 12 to 18 carbon atoms in the higher fatty alcohol and of about 20 moles of ethylene oxide per mole). In the mixture of fabric softener, flow improving agent and emulsifier, the proportionsthereof will ideally be about 8.5%, 0.1% and 0.8%, on a final product basis, which corresponds to about 90%, 1% and 9% of the mixture, respectively. Corresponding useful ranges of such components are 80 to 95%, 0.2 to 5% and 4 to 15%, respectively. In addition to the Microcel C that is added in conjunction with the fabric softener and emulsifier, 0.3 to 2% (about 0.7% ideally) on a final product basis, is also blended in with the perfumed detergent powder, enzyme mixture, PET-POET-polyacrylate blend and fabric softening mixture, for its flow improving qualities. Improvement of the flow of the product is of importance in automatic production of the detersive articles, especially in the filling of the pouches, where dependable flow of the composition to the pocket formed by the pouch material is required. Also of some importance are the anticaking properties of the hydrated synthetic calcium silicate, which are considered to be of assistance in evacuating the pouch when the invented article is added to the wash water in an automatic washing machine.

Although it is highly preferred that the base beads of the compositions of this invention be spray dried, because spray dried beads tend to be more porous and therefore better able to absorb liquid detergent, under some circumstances granular components or agglomerates may be employed, providing that they are sufficiently absorbent. For the manufacture of the phosphate-built detergent composition it will be preferred to employ hydrated or humidified pentasodium tripolyphosphate as a phosphate starting material, but that is not required.

In the final mixing step, when the various powders are mixed with the particulate detergent composition intermediate, the powders will tend to coat such intermediate particles but that is not to say that all such powders applied actually form coatings on the intermediate particles. Some do but some may form independent particles or may agglomerate with other additives. However, coating of the intermediate particles does appear to occur to a desirable extent, whereby flowability is increased and separation and sifting are decreased. The product resulting, although it may contain some of the added powders in finely divided form, is essentially or substantially of particle sizes in a range of 10 to 100, U.S. Sieve Series, preferably 10 to 60.

In making of the invented fabric softening detersive articles, after completion of the manufacturing of the fabric softening detergent composition, such composition is fed to conventional packaging equipment, which automatically fills and heat seals the composition into cavities between strips of the described woven or nonwoven fabrics, to make the flat pillow-shaped articles described herein. After such filling the various packets are cut from the formed strip, when desired, and are packed in boxes, larger envelopes, cartons or other suitable containers.

In use of the invented articles the consumer fills the washing machine with water, which may be of any hardness, but preferably is of a hardness in the range of 25 to 150 p.p.m. as calcium carbonate. The wash water, at a temperature in the range of 15° to 70° C., usually 20° to 40° C., is normally of a volume in the range of 50 to 75 liters per wash and to such wash water one of the invented articles is added for lightly or normally soiled laundry, and two packets are added for more heavily soiled laundry. The laundry to be washed is then added to the washing machine, with the weight charged usually being in the range of 2 to 4 kg., and washing is commenced. The wash cycle normally takes from 10 minutes to one hour, preferably 15 to 30 minutes and after washing the laundry is usually rinsed twice, automatically. It is then spin dried and removed from the washing machine in damp state, together with the fabric softening detersive article(s), and with such is placed in an automatic laundry dryer, where it is subjected to a normal hot or warm air drying, depending on fabric types. After completion of drying tests of the laundry will show that it is satisfactorily cleaned, desirably soft, and contains no quat spots or yellow stains due to the quaternary fabric softener, and is satisfactorily brightened by the stilbene brightener of the composition. Examination of the invented article, upon removal from the dried laundry, normally shows that it has been completely evacuated of initially contained fabric softening detergent composition particles. Under poor conditions for solubilizing, as when the wash water is cool or cold and gentle or minimal agitation is employed, sometimes a small proportion of builder salt, usually less than 5% and often less than 1%, may be present in the packet. However, when the invented article is removed from the washing machine and is not added to the dryer it will usually be found that the contents thereof have been completely evacuated or that only a very small proportion, less than 1% thereof remains, evidencing that during the washing cycle (and possibly also during any rinsing cycles) the cationic fabric softener was transported through the permeable pouch to the washing or rinsing medium, wherein it acted to soften the laundry.

The following examples illustrated but do not limit the present invention. All parts are by weight and all temperatures are in °C. in such example, this specification and the appended claims, unless otherwise indicated.

EXAMPLE 1

To 50.251 parts of tap water in a conventional detergent crutcher (or soap crutcher) there are added 0.422 part of fluorescent brightener (Tinopal UNPA, manufactured by CIBA-Geigy Corp.), 8.658 parts of 47.5% aqueous sodium silicate solution ($Na_2O:SiO_2=1:2.4$) and 40.669 parts of pentasodium tripolyphosphate (humidified) to produce a 45% solids content crutcher mix, which is at a temperature of about 60° C. The crutcher mix is then pumped to a conventional spray drying tower, wherein it is dried in a hot drying gas at a temperature of about 400° C., to form 52.001 parts of spray dried base beads of sizes in the range of No's. 10 to 100, U.S. Sieve Series, having a moisture content of 13.5%. After cooling, 72.594 parts of such base beads have sprayed onto moving surfaces thereof 19.000 parts of Neodol 25-7 (condensation product of a higher fatty alcohol averaging 12 to 15 carbon atoms, with about 7 moles of ethylene oxide per mole, sold by Shell Chemical Company) and 7.935 parts of a 60% aqueous solution of triethanolamine linear dodecylbenzene sulfonate (TEALDBS). The TEALDBS solution includes 4.761 parts of TEALDBS and 3.174 parts of water. The common solution of the nonionic detergent, anionic surfactant and water (cosolvent), at a temperature of 32° C., is sprayed onto moving surfaces of the base beads, is absorbed by such beads and penetrates into the interiors thereof, while also coating such beads. Additionally, 0.471 part of perfume is also sprayed onto such moving beads. The moisture content of the 100.000 parts of intermediate product resulting is about 12.6%.

Such intermediate particulate product is then blended with other particulate or powdered componnts of the final formula of the fabric softening detergent composition. In such final blending, which also takes place in a suitable mixer for particulates, such as an inclined drum, 84.970 parts of the previously described intermediate detergent product are blended with: 1.060 parts of a mixture of proteolytic and amylolytic enzymes (Maxatase MP 37500); 3.700 parts of an 80:20 blend of PET-POET copolymer (Alkaril QCF, of weight average molecular weight of about 22,000, with the molecular weight of the polyoxyethylene being about 3,400 and the molar ratio of PET to POET units being about 3:1 (manufactured by Alkaril Chemicals, Inc.), and Alcosperse 107D (sodium polyacrylate of molecular weight of about 2,000); 9.600 parts of softener pre-mix;and 0.670 part of Microcel C. The softener pre-mix includes 8.448 parts of dimethyl distearyl ammonium chloride, 0.768 part of higher fatty alcohol ethylene oxide condensation product (surfactant and emulsifier) in which the higher fatty alcohol averages 12 to 18 carbon atoms and is condensed with about 20 moles of ethylene oxide per mole, and 0.096 part hydrated synthetic calcium silicate (Microcel C). The balance of 0.288 part of the softener pre-mix is primarily moisture, which may be present in the cationic softener component of the premix. The additional 0.670 part of Microcel C is added to improve flowability of the final product. Some Microcel C is also present in the softener pre-mix to improve flowability thereof and the nonionic surfactant is present in it to promote ready wetting of the softener, dispersion of it in the aqueous medium that is present in the pouch after addition of the article to the wash water, and transport of the softener through the pouch walls.

The following is the formula of the final fabric softening detergent composition made, which is contained in the invented articles of this example.

| Component | Parts (by weight) |
|---|---|
| Phosphate solids (from sodium tripolyphosphate) | 48.000 |
| Silicate solids (from sodium silicate, of $Na_2O:SiO_2$ = 1:2.4) | 4.878 |
| Polyethoxylated higher fatty alcohol (Neodol 25-7) | 16.144 |
| TEALDBS | 4.045 |
| Alkaril QCF | 2.960 |
| Alcosperse 107D | 0.740 |
| Dimethyl distearyl ammonium chloride | 8.448 |
| Polyethoxylated higher fatty alcohol (condensation product of higher fatty alcohol averaging 12–18 carbon atoms with 20 moles of ethylene oxide per mole) | 0.768 |
| Microcel C | 0.766 |
| Enzymes mixture | 1.060 |
| Fluorescent brightener | 0.500 |
| Perfume | 0.400 |
| Water | 11.291 |
| | 100.000 |

The final fabric softening detergent composition described above is of particles substantially within the No's. 10 to 100 range, U.S. Sieve Series, with over 90%, by weight, of the particles within such range and often with over 95% thereof in such range. Ideally, all the particles are within the No's. 10 to 60 range, with smaller particles often being adhered to larger particles so as to make the effective particle sizes within such rage. Thus, it may be considered that in such products the more finely powdered components, such as those added in the final blending, which may have particle sizes as small as No. 200, U.S. Sieve Series, coat the larger particles of base beads, containing detergents and perfume. The fabric softening detergent composition described is satisfactorily free flowing, flowing through a restricted orifice at a speed of about 70% that of dry sand, which satisfactorily meets a standard of flowability for spray dried detergent compositions.

After manufacture, the particulate fabric softening detergent composition may be aged, such as overnight, before being filled into water permeable pouches or packets, but in some instances it may be filled directly. Filling is preferably by automatic packaging machinery, in the operation of which strips of fabric or web material are fed in parallel, the particulate composition is fed between them, into a pocket created by the machine, the edges of the strips are heat sealed or otherwise fastened together and individual packets or pouches are separated from the strip, as by automatic cuttings. Instead of automatic machinery, semi-automatic machinery may be used and in some cases the packets may be filled manually, using measured amounts of composition, after which sealing of the packet or pouch is effected, usually at only a single unsealed end. The filled pouches, which are the fabric softening detersive articles of the present example, are then boxed or cartoned, or are packed in polyethylene bags or other suitable containers, in which they are to be marketed.

Although a variety of types of web materials may be employed that described in this example is a 100% nonwoven polyester material, manufactured by Kendall Company, identified by them as SP 284.1, which is made of 3-denier polyester fiber. Such fabric weighs approximately 40 g./sq. m. and is of an air permeability of about 2 cu. m./min./sq. cm.

The article made is essentially square, with the filled volume (excluding the heat sealed edges) measuring about 10 cm. by 10 cm. by 1 cm. It contains 50 grams of composition, the bulk density of which is about 0.5 g./cu. cm.

In practical use testing one such article is added to 64 liters of tap water (150 p.p.m. hardness, as $CaCO_3$) at 21° C. in a top loading automatic washing machine, after which 2.7 kg. of assorted laundry, largely polyester, polyester-cotton blends and cotton items, are added to the wash water. The washing machine is set for normal washing, with the wash period lasting for 20 minutes, and the laundry is subsequently rinsed twice (cold water rinses) and spun dried. Next, it and the damp pouch, which is substantially empty (over 99.9% evacuated) are placed in an automatic laundry dryer and are dried for 40 minutes at medium heat. The laundry is removed from the dryer and the pouch is examined. The pouch contains no residue, and it is discarded. The laundry is observed by a panel of evaluators, who are familiar with detergency and softness evaluations of laundry. The various laundry articles are found by them to be satisfactorily clean and soft, and essentially static-free. Thus, the invented articles satisfactorily release fabric softening detergent composition into the wash water and such composition satisfactorily cleans and softens laundry, leaving no quat spots on the laundry, and not yellowing it or adversely affecting the fluorescent brightener present.

In addition to the importance of having the composition evacuate the pouch so that no residue is left therein it is also important for the composition to evacuate the pouch early in the washing operation, say in the first five minutes thereof, so that the laundry being washed and softened will be in contact with washing and softening compounds for reasonably long period of time so that such compounds may exert substantially their full effects. When, during the washing operation, the pouch is removed from the wash water after five minutes washing,it is found to be substantially (over 95%) emptied of its former contents, evidencing that the transport of the fabric softening detergent composition through the pouch walls to the wash water is not only complete, but is also rapid.

In the above example the Neodol 25-7 employed is a BRE nonionic detergent. When an NRE nonionic detergent, Tergitol 24-L-60N, replaces the Neodol 25-7, transport of the composition through the pouch walls is also complete and rapid, and cleaning and softening of the laundry are just as effective. Additionally, as is taught in U.S. patent application Ser. No. 084,524 (Holland and Buda), filed Aug. 10, 1987, the "NRE" detergent composition synergistically improves the soil release promoting effect of the PET-POET copolymer, thereby improving subsequent cleanings. Similar advantageous results are obtained when the Neodol 25-7 is replaced with Shell Development Company NRE nonionic detergents 23-7P and 23-7Z.

When control articles containing no anionic surfactant (TEALDBS) in the composition formula are made, with that being the only variation from the BRE and NRE formulas of the present example, as they were described above, the articles made do not wash laundry as well and do not soften it as well as those previously described herein. The reason for this is evident, with substantially greater quantities of particulate composition remaining in the pouches of the controls after washing. In some instances, such prbportion still remaining in the pouch exceeds 20% of the initial composition. The residue appears to be a reaction product of the cationic softening compound and builder(s). However, when sodium linear dodecylbenzene sulfonate is present as a replacement for the TEALDBS, even when it is separately blended with the particulate product after absorption of the liquid state nonionic detergent only by the spray dried base beads, the residue in the pouch after washing is strikingly diminished also, with as little as 0.1% or no residue often being present.

The observations of residue amounts mentioned above are consistent with results obtained in laboratory testings of different articles like those of this invention under "difficult evacuating conditions", such as low water temperature, gentle agitation, short washing periods, and positioning of the article in the laboratory washing machine at a location where agitation is relatively poor. In such laboratory tests it is confirmed that the presence of the anionic surfactant in the particulate composition in the pouch effectively promotes transport of the contents through the pouch walls and into the wash water, and decreases residue, often to zero.

EXAMPLE 2

To 39.841 parts of tap water in a conventional detergent crutcher there are added 0.460 part of Tinopal UNPA fluorescent brightener, 16.483 parts of sodium bicarbonate, 16.922 parts of sodium carbonate, (natural soda ash) and 26.294 parts of Zeolite 4A hydrate (anhydrous basis), to produce a 54.9% solids content crutcher mix, which is at a temperature of about 60° C. For improved crutching and absorbency of the spray dried beads, with acceptable bead strength, the crutcher mix is made by first adding the fluorescent brightener to the water in the crutcher, followed by the bicarbonate, the carbonate and zeolite. Such additions are made while the water or aqueous mix is being agitated, and the addition of the carbonate is in two steps, with 80% thereof being added in a first step, with maximum agitation, after which addition agitation is continued for about three minutes, followed by admixing of the balance of the carbonate, with agitation being continued for another minute, followed by addition of the zeolite. (Such mixing procedure is not the invention of the present inventors but resulted from the work of a colleague, working for their assignee corporation). The crutcher mix resulting (100.000 parts) is then pumped to a conventional spray drying tower, in which it is dried in a hot drying gas at a temperature of about 400° C., to form 56.766 parts of spray dried base beads of sizes in the range of No's. 10 to 100, U.S. Sieve Series, having a moisture content of 8.2%. During the spray drying operation some of the bicarbonate is converted to carbonate, with the release of water and carbon dioxide.

After cooling of the base beads to room temperature, 72.594 parts of such base beads then have sprayed onto moving surfaces thereof, while the beads are being kept in motion in a suitable mixer, e.g., an inclined drum mixer, 19.000 parts of Neodol 25-7, 4.761 parts of TEALDBS, and 3.174 parts of water. The water normally accompanies the TEALDBS, as supplied, in a 60% solids aqueous solution. The nonionic detergent, anionic surfactant and water in common solution, at a temperature of 32° C., are sprayed onto moving surfaces of the base beads. The solution is absorbed by such beads and penetrates into the interiors thereof, while also coating, or at least partially coating such beads. Additionally, 0.471 part of perfume is also sprayed onto the moving beads. The moisture content of the 100.000 parts of intermediate product resulting is about 8.7%.

Such intermediate particulate product is then blended with other particulate or powdered components of the final formula of the fabric softening detergent composition. In such final blending, which also takes place in a suitable mixer for particulate mterials, such as an inclined drum, 84.970 parts of the described particulate intermediate product are blended with: 1.060 parts of Maxatase MP 37500; 3.700 parts of an 80:20 blend of Alkaril QCF and Alcosperse 107D; 9.600 parts of softener pre-mix; and 0.670 part of Microcel C. The softener pre-mix includes 8.448 parts of dimethyl distearyl ammonium chloride, 0.768 part of higher fatty alcohol ethylene oxide condensation product (a surfactant-/emulsifier, in which the higher fatty alcohol averages 12 to 18 carbon atoms and is condensed with about 20 moles of ethylene oxide per mole), and 0.096 part of Microcel C. The balance of 0.288 part of the softener per-mix is primarily moisture, which may be present with the cationic softener component of the pre-mix, as supplied. The additional 0.670 part of Microcel C is added to improve flowability of the final product, and it speeds machine fillings of the pouches with such product. Microcel C is also present in the softener pre-mix to improve the flowability thereof. Nonionic surfactant is present in the softener pre-mix to promote wetting of the softener, dispersion of it in the aqueous medium that is formed in the pouch after addition of the article to the wash water, and transport of the softener through the pouch walls.

The following is the formula of the final fabric softening detergent composition made, which is the contents of the pouches, to be described.

| Component | Parts (by weight) |
|---|---|
| Sodium carbonate | 23.569 |
| Sodium bicarbonate | 9.699 |
| Zeolite (anhydrous basis) | 22.857 |
| Neodol 25-7 | 16.144 |
| TEALDBS | 4.045 |
| Alkaril QCF | 2.960 |

-continued

| Component | Parts (by weight) |
|---|---|
| Alcosperse 107D | 0.740 |
| Dimethyl distearyl ammonium chloride | 8.448 |
| Condensation product of higher fatty alcohol averaging 12–18 carbon atoms with 20 moles of ethylene oxide per mole | 0.768 |
| Microcel C | 0.766 |
| Enzyme mixture (proteolytic and amylolytic mixture) | 1.060 |
| Fluorescent brightener (stilbene type) | 0.500 |
| Perfume | 0.400 |
| Water | 8.044 |
| | 100.000 |

The fabric softening detergent composition of this example is comprised of particles which are substantially within the range of No'3 s, 10 to 100, U.S. Sieve Series, with over 90%, by weight, of the particles being within that range and often with over 95% thereof being of such sizes. Oversized and undersized particles may be removed by screening or other classification operations. It is preferred for all the particles to be within the No's. 10 to 60 range, with smaller particles often being adhered to or coating larger particles so as to make their effective particle sizes larger, and within such range. Thus, it may be considered that finely divided powdered components of such products, such as those admixed in the final blending, which sometimes may be of particle sizes as small as No. 200, U.S. Sieve Series, can deposit on and coat larger particles of the base beads. Such larger particles contain detergents and perfume, which may help to hold the smaller particles.

The fabric softening detergent composition described is satisfactorily free flowing, and can pass through a restricted orifice or exit passageway from a container at a velocity about 70% of that of dry sand, thereby meeting a standard for good flowability of spray dried detergent compositions.

After manufacture, the particulate composition may be aged (which is often preferred) before being filled into water permeable pouches, but in some instances it may be filled directly, without any intermediate aging. Such filling is preferably by automatic packaging machinery, in the operation of which strips of fabric or web material are fed in parallel, the particulate composition is fed between them, into a pocket created by the machine, the edges of the strips are heat sealed or otherwise fastened together and individual packets or pouches are separated from the strip, as by automatic cutting operations. The filled pouches are then packed in cartons for warehousing, shipping and sale.

The webbed material employed as a feed to the automatic package making and filling machine is a 100% nonwoven polyester material, Kendall SP 284.1, which is made of 3-denier polyester fiber. Such fabric weighs approximately 40 g./sq. m. and is of an air permeability of about 2 cu. m./min./sq. cm. The article made is essentially square, with the filled volume, excluding heat sealed edges, measuring about 10 cm. by 10 cm. by 1 cm. It contanns 50 grams of composition, the bulk density of which is about 0.5 or 0.6 g./cu. cm.

Practical use tests, like those described for the articles of Example 1, yield essentially the same results, and such are confirmed by laboratory tests, in which washing conditions, including agitation, are controlled and are held constant for both experimental and control runs. Thus, despite the fact that the composition of the present articles includes a substantial percentage of water insoluble material (zeolite), and despite the fact that the carbonate, being more alkaline, is more likely to react with the cationic softening compound than is the polyphosphate of the articles of Example 1, evacuation of the pouch by the detergent composition is obtained, which is attributable to the presence of the anionic surfactant in the fabric softening detergent composition.

When control articles containing no anionic surfactant in the composition formula are made, with that being the only variation from the previous composition formula of this example, substantially greater quantities of particulate composition remain in the pouches after completion of washing, which leads to significantly poorer cleaning of the laundry and to less effective softening of it. In such instances, the proportion of such composition remaining in the pouch after washing may exceed 10% of the initial composition. Such residue is a reaction product of the cationic softening compound and a builder, apparently with the carbonate builder. When sodium linear dodecylbenzene sulfonate is employed, in replacement of TEALDBS in the formula but is admixed with the intermediate detergent particles (rather than being sprayed onto base beads in common solution with the nonionic detergent), no improvement in composition transport through the pouch walls is obtained. In fact, the amount of residue remaining is greater and the softening action is worse.

In this example, as in Example 1, the BRE nonionic detergent employed, Neodol 25-7, can be replaced by an NRE nonionic detergent, and such replacement is preferable, as a general rule. Thus, when Tergitol 24-L-60N (or Neodol 23-7P or Neodol 23-7Z) replaced the Neodol 25-7 desired cleaning and softening of the laundry are obtained, as with the article containing the BRE nonionic detergent composition, but the NRE detergent composition additionally synergistically improves the soil release promoting effect of the Alkaril QCF copolymer and thereby improves subsequent cleanings.

EXAMPLE 3

(Additional Variations of the Invention)

Other fabric softening detergent compositions comprising other components described in the specification may be made and may be employed in the pouches of the foregoing examples to produce articles which will satisfactorily evacuate contained compositions and will clean and soften laundry. Thus, in addition to, or at least in partial replacement of, the particular BRE and NRE nonionic detergents recited in the mentioned examples there may be employed other nonionic detergents, such as Neodol 23-6.5; Igepal CO-630; and Pluronic F-68, or equivalents, and corresponding NRE nonionic detergents, and the builders may be varied, as taught in the specification. Similarly, other cationic softening compounds, includingoother quaternary ammonium compounds, e.g., cetyl trimethyl ammonium bromide, dimethyl.ditallowalkyl ammonium chloride, and imidazolinium salts, e.g., 2-heptadecyl-1-methyl-1-[(2-stearoylamido) ethyl] imidazolinium methyl sulfate, may be employed. The TEALDBS may be replaced by other anionic surfactants, preferably triethanolamine salts, such as triethanolamine lauryl sulfate, but corresponding sodium and potassium salts may also be substituted in suitable circumstances (with the sodium salts preferably being limited to use in phosphate-built detergent compositions). The various adjuvants present in the compositions of the examples may be varied and some or all of them may be omitted (except that some moisture is normally present).

In addition to the substitutions of other components for those of the preceding examples (such other components are mentioned in the present specification), the proportions of components, as given in the examples, may be varied, for example, ±10%, and ±25%, providing that such proportions are kept within the ranges recited in this specification.

Instead of employing a non-woven polyester fabric pouch, such pouches may be made of other materials, including mixed polyester-cotton, e.g., 50:50 polyester:-cotton, rayon, nylon, blends of such synthetics and blends thereof with natural fibers, such as blends with cotton. The fabrics may be woven or non-woven and the fibers may be of different deniers (although preferably they will be of about the same denier), weights and permeabilities, providing that such allow the satisfactory evacuation of the composition from the pouch (or other permeable container)during automatic washing machine washing of laundry, but normally the denier, weight of fabric and its permeability will be within preferred ranges given in the specification.

Although the pouches for the invented articles are very preferably automatically manufactured by package making and filling equipment they may also be made by hand, and instead of the edges being heat sealed they may be sealed by adhesive, solvent, fusion of the polymeric material, stitching or stapling. The size, shape, weight of contents and density of contents in the pouch may be varied and such pouches may be replaced by permeable containers of fixed size and shape, such as closed end tubes.

In the manufacturing of the detergent composition, instead of spraying the mutual solution of nonionic detergent, anionic surfactant and solvent medium onto the base beads, the nonionic and anionic components may be separately absorbed by such beads, but it is preferred to apply them as the described single solution to save an additional operation and to promote penetration into the pores of the beads. The temperature of application may be changed to any suitable temperature at which the mixture is in liquid state but normally will be held to within the 30° to 40° C. range. In some instances, instead of spraying the liquid onto the moving base beads, such application may be made by dripping the liquid onto the beads or applying it to them as a stream or "sheet". In such instances reliance will be on maintaining the bed of beads sufficiently agitated to distribute the liquid over the surfaces thereof.

In the washing of laundry with an article or articles of this invention the consumer is always assured of having the right amount of detergent composition in the wash water for a normal wash load, and pouring and measuring of detergent powder are avoided. The wash water hardness will normally be less than 300 p.p.m., as $CaCO_3$, but harder waters can be used. Washing temperatures will usually be less than 70° C. but higher temperatures are operative and sometimes the use of higher temperature wash waters can be more desirable, because heat promotes the solubilizing of the contained composition and thereby aids in transporting it through permeable container walls. The washed laundry will usually contain some synthetic fabrics or mixed synthetic-natural fabrics but the invention is operative with laundry made only of natural fibrous material, e.g., cottons. After washing in the washing machine (which is normally automatic) the laundry is usually machine dried but improved fabric softening, compared to a control, is noted for laundry items that are line dried, too, although improvements in softening thereof are not as significant.

Where, in the above description molecular weights and/or carbon atom contents of compounds were given they may be considered to apply to average molecular weights, as well as actual molecular weights.

The invention has been described with respect to illustrations and working embodiments thereof but it is not to be considered as limited to these because it is evident that one of skill in the art will be able to utilize substitutes and equivalents without departing from the invention.

What is claimed is:

1. A fabric softening and detersive article for use in an automatic washing machine to wash and soften laundry, which article comprises a water insoluble container having a fabric softening particulate built laundry detergent composition which is transported through a permeable wall of said container as an aqueous solution, emulsion or dispersion, into the to wash water of the automatic washing machine, so that the laundry in the wash water may be washed and softened thereby, wherein the fabric softening detergent composition comprises a detersive proportion of nonionic detergent, a building proportion of builder for the nonionic detergent, a fabric softening proportion of fabric softening cationic compound and a transport promoting proportion of anionic surface active agent (surfactants), which proportion of anionic surfactant is less than the proportions of the nonionic detergent and of the fabric softening cationic compound, and which anionic surfactant solubilizes, emulsifies and/or disperses component(s) of the fabric softening detergent composition, including the fabric softening cationic compound, in the permeable container so that substantially all of such composition and such compound is transported out of the container and into the wash water during washing of laundry in the washing machine.

2. A fabric softening and detersive article according to claim 1 wherein the water permeable insoluble container is a permeable pouch of thin material, the proportion of nonionic detergent in the detergent composition is in the range of 8 to 40%, the proportion of builder therein is in the range of 30 to 70%, the proportion of fabric softening cationic compound therein is in the range of 0.5 to 15%, and the proportion of anionic surfactant therein is in the range of 1 to 8%.

3. A fabric softening and detersive article according to claim 2 wherein the permeable pouch is of nonwoven synthetic organic polymeric material, the nonionic detergent is a condensation product of ethylene oxide and higher fatty alcohol, in which the higher fatty alcohol averages in the range of 10 to 18 carbon atoms and the ethylene oxide content of the nonionic detergent averages in the range of 3 to 15 moles of ethylene oxide per mole of higher fatty alcohol, the builder salt is selected from the group consisting of alkali metal tripolyphosphate, alkali metal silicate, alkali metal carbonate, alkali metal bicarbonate, alkali metal borate, alkali metal citrate, alkali metal gluconate, NTA, zeolite, and mixtures thereof, the fabric softening cationic compound is of the formula

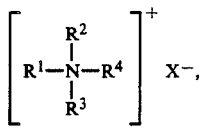

wherein $R^1$ and $R^2$ are lower alkyl of 1 to 3 carbon atoms, $R^3$ is higher alkyl of 10 to 20 carbon atoms, $R^4$ is alkyl of 1 to 20 carbon atoms, and X is either chlorine or bromine, and the anionic surfactant is a detergent which is an alkali mctal or alkanolamine higher alkylbenzene sulfonate, an alkali metal or alkanolamine higher fatty alcohol sulfate, or an alkali metal or alkanolamine higher fatty alcohol polyethoxy sulfate, or a mixture thereof, wherein the higher alkyl is of 12 to 16 carbon atoms, the higher fatty alcohol is of 12 to 18 carbon atoms, the polyethoxy is of 3 to 15 ethoxy groups, and the alkanolamine is mono-, di- or tri-lower alkanolamine of 1 to 3 carbon atoms.

4. An article according to claim 3, wherein the pouch is of non-woven polyester, nylon or rayon fibers, or any mixture thereof, the nonionic detergent is a condensation product of ethylene oxide and higher fatty alcohol in which the higher fatty alcohol averages 10 to 16 carbon atoms and the ethylene oxide content of the nonionic detergent averages 3 to 10 moles of ethylene oxide per mole, the builder is a mixture of sodium tripolyphosphate and sodium silicate with the weight of the tripolyphosphate being from 5 to 20 times the weight of the silicate, the quaternary ammonium salt is a di-lower alkyl di-higher alkyl ammonium chloride wherein the lower alkyls are of 1 to 2 carbon atoms and the higher alkyls are of 12 to 20 carbon atoms, and the anionic detergent is triethanolamine higher alkylbenzene sulfonate wherein the higher alkyl is of 12 to 14 carbon atoms.

5. An article according to claim 4, wherein the proportion of nonionic detergent in the detergent composition is 12 to 25%, the proportion of builder salt mixture therein is 40 to 65%, the proportions of sodium tripolyphosphate and silicate being 40 to 60% and 3 to 8%, respectively, the proportion of quaternary ammonium salt therein is 7 to 10%, and the proportion of anionic detergent therein is 3 to 6%, and the pouch is heat sealed and is of a size to be readily holdable in a human hand, with a total permeable surface area, through which water and solutions), emulsion(s) and/or dispersion(s) of detergent composition constituents can pass, in the range of 100 to 500 sq. cm., measured externally, and with the weight of detergent composition in the permeable pouch in the range of 30 to 100 grams.

6. An article according to claim 1 wherein the fabric softening particulate built laundry detergent composition is of spray dried builder beads having absorbed therein the nonionic detergent and anionic surfactant and having particulate fabric softening cationic compound mixed with such builder-nonionic detergent-anionic surfactant particles.

7. An article according to claim 5, wherein the higher fatty alcohol of the nonionic detergent is a mixture of higher fatty alcohols averaging 12 to 15 carbon atoms in the molecules thereof, the ethylene oxide content of the nonionic detergent averages 6 to 7 moles per mole of higher fatty alcohol, the content of nonionic detergent in the detergent composition is about 16%, the water soluble inorganic builder salt mixture is about 48% of pentasodium tripolyphosphate and about 5% of sodium silicate, of $Na_2O:SiO_2$ ratio of about 1:2.4, the quaternary ammonium salt is dimethyl distearyl ammonium chloride and the proportion thereof in the detergent composition is about 8.5%, and the anionic detergent is triethanolamine linear dodecylbenzene sulfonate and the proportion thereof in the detergent composition is about 4%, with all percentages and proportions being on a final product weight basis.

8. An article according to claim 7 wherein the fabric softening particulate built laundry detergent composition is of spray dried builder beads, which contain both pentasodium tripolyphosphate and sodium silicate, and are of particle sizes in the range of No's. 10 to 100, U.S. Sieve Series, having absorbed therein the higher fatty alcohol ethylene oxide condensate nonionic detergent and the triethanolamine linear dodecylbenzene sulfonate anionic detergent, and having particulate fabric softening dimethyl distearyl ammonium chloride mixed with, adhering to and coating such builders-nonionic detergentanionic detergent particles.

9. An article according to claim 8, in which the fabric softening detergent composition also comprises about 3% of polyethylene terephthalate-polyoxyethylene terephthalate (PET-POET) soil release promoting copolymer of molecular weight in the range of 19,000 to 43,000, with the molecular weight of the polyoxyethylene thereof being in the range of about 2,500 to 5,000, with the molar ratio of PET to POET units being in hhe range of 2:1 to 6:1, and with the proportion of ethylene oxide to phthalic moiety in the copolymer being in the range of 20:1 to 30:1, about 1% of proteolyticamylolytic enzymes mixture, about 0.7%, df sodium polyacrylate of molecular weight in the range of 1,000 to 3,000, about 0.8% of calcium silicate, as a flow promoting agent, about 0.5% of fluorescent brightener, about 0.4% of perfume, and about 11% of water, and in which the pouch is of polyester filaments of a denier in the range of 2 to 4, in the form of a non-woven sheet of a thickness in the range of 0.1 to 1 mm. and an air permeability in the range of 10 to 15 cu. m./min., is substantially square, is heat sealed at a plurality of sides thereof and is of a total permeable surface area of about 200 sq. cm., measured externally, and the weight of fabric softening detergent composition in the permeable pouch is about 50 g.

10. An article according to claim 6 wherein the nonionic detergent is a narrow range ethoxylate (NRE), which is a polyethoxylated lipophile, ethoxylated with an average of 5 to 10 ethylene oxide groups per mole, and with at least 70% of the ethylene oxidebeing in polyethoxy groups of 4 to 12 ethylene oxides.

11. An article according to claim 8 wherein the nonionic detergent is a narrow range ethoxylate (NRE), in which the higher fatty alcohol moiety is saturated and is of an average of 12 to 14 carbon atoms and over 85% of the ethylene oxide present in such NRE is present as polyethoxy groups of 5 to 10 moles of ethylene oxide.

12. An article according to claim 3, wherein the pouch is of non-woven polyester, nylon or rayon fibers, or any mixture thereof, the nonionic detergent is a condensation product of ethylene oxide and higher fatty alcohol in which the higher fatty alcohol beverages 10 to 16 carbon atoms and the ethylene oxide content of the nonionic detergent averages 3 to 10 moles of ethylene oxide per mole, the builder is a mixture of sodium carbonate, sodium bicarbonate and hydrated zeolite, with the weight of sodium carbonate being from 0.7 to 1.5 times the weight of zeolite (anhydrous basis) and the weight of sodium bicarbonate being, from 0.3 to 0.7 times the weight of sodium carbonate, the quaternary ammonium salt is a di-lower alkyl di-higher alkyl ammonium chloride wherein the lower alkyls are of 1 to 2 carbon atoms and the higher alkyls are of 12 to 20 carbon atoms, and the anionic detergent is triethanolamine higher alkylbenzene sulfonate wherein the higher alkyl is of 12 to 14carbon atoms.

13. An article according to claim 12 wherein the proportion of nonionic detergent in the detergent composition is 12 to 25%, the proportion of builder salt mixture therein is 40 to 65%, the proportions of sodium carbonate, sodium bicarbonate and hydrated zeolite, as the anhydride, being 15 to 35%, 5 to 20% and 10 to 35%, respectively, the proportion of quaternary ammonium salt is 7 to 10%, and the proportion of anionic detergent is 3 to 6%, and the pouch is heat sealed and is of a size to be readily holdable in the human hand, with a total permeable surface area, through which water and solution(s), emulsion(s) and/or dispersion(s) of detergent composition constituents can pass, in the range of 100 to 500 sq. cm., measured externally, and with the weight of detergent composition in the permeable pouch in the range of 30 to 100 grams.

14. An article according to claim 13 wherein the higher fatty alcohol of the nonionic detergent is a mixture of higher fatty alcohols averaging 12 to 15 carbon atoms in the molecules thereof, the ethylene oxide content of the nonionic detergent averages 6 to 7 moles per mole of higher fatty alcohol, the content of nonionic detergent in the detergent composition is about 16%, the proportion of inorganic builder salt mixture is about 24% of sodium carbonate, about 10% of sodium bicarbonate and about 23% of hydrated sodium zeolite (anhydrous basis), the quaternary ammonium salt is dimetlyl distearyl ammonium chloride and the proportion thereof in the detergent composition is about 8.5%, and the anionic detergent is triethanolamine linear dodecylbenzene sulfonate and the proportion thereof in the detergent composition is about 4%, with all percentages and proportions being on a final product weight basis, except for the zeolite percentage, which is a percentage of anhydrous zeolite (water of hydration being removed) on such final product basis.

15. An article according to claim 14 wherein the fabric softening particulate built laundry detergent composition is of spray dried builder beads which contain sodium carbonate, sodium bicarbonate and hydrated zeolite, and are of particle sizes in the range of No's. 10 to 100, U.S. Sieve Series, having absorbed therein the higher fatty alcohol ethylene oxide condensate nonionic detergent and the triethanolamine linear dodecylbenzene sulfonate anionicddetergent, and having particulate fabric softening dimethyl distearyl ammonium chloride mixed with, adhering to and coating such builders-nonionic detergent-anionic detergent particles.

16. An article according to claim 15 in which the fabric softening detergent composition also comprises about 3% of polyethylene terephthalate-polyoxyethylene terephthalate (PET-POET) soil release promoting copolymer of molecular weight in the range of 19,000 to 3,000, with the molecular weight of the polyoxyethylene thereof being in the range of about 2,500 to 5,000, with the molar ratio of PET to POET units being in the range of 2:1 to 6:1 and with the proportion of ethylene oxide to phthalic moiety in the copolymer being in the range of 20:1 to 30:1, about 1% of proteolytic-amylolytic enzymes mixture, about 0.7% of sodium polyacrylate of molecular weight in the range of 1,000 to 3,000, about 0.8% of calcium silicate as a flow promoting agent, about 0.5% of fluorescent brightener, about 0.4% of perfume and about 8% of water, and in which the pouch is of polyester filaments of a denier in the range of 2 to 4, in form of a woven sheet of a thickness in the range of 1.0 to 1.2 mm. and an air permeability in the range of 1 to 3 cu. m./min./sq. cm., is substantially square, is heat sealed at a plurality of sides thereof and is of a total permeable surface area of about 200 sq. cm., measured externally, and the weight of fabric softening detergent composition in the permeable pouch is about 50 g.

17. An article according to claim 12 wherein the nonionic detergent is a narrow range ethoxylate (NRE), which is a polyethoxylatedlipophile, ethoxylated with an average of 5 to 10 ethylene oxide groups per mole, and with at least 70% of the ethylene oxide being in polyethoxy groups of 4 to 12 moles of ethylene oxide.

18. An article according to claim 14 wherein the nonionic detergent is a narrow range ethoxylate (NRE) in which the higher fatty alcohol moiety is saturated and is of 12 to 14 carbon atoms, and over 85% of the ethylene oside present in the polyethoxy moiety of such NRE is present as polyethoxy groups of 5 to 10 moles of ethylene oxide.

19. A process for manufacturing a fabric sotening detergent composition, suitable for dispensing into wash water in an automatic washing machine from a water permeable, water insoluble container through a permeable wall thereof, which comprises spray drying an aqueous crutcher mix of builder(s) to produce porous base beads, making a liquid detergent solution of 3 to 6 parts of anionic detergent selected from the group consisting of alkali metal and alkanolamine higher alkylbenzene sulfonates, alkali metal and alkanolamine higher fatty alcohol sulfates and alkali metal and alkanolamine higher fatty alcohol polyethoxy sulfates and mixtures thereof, wherein the higher alkyl is of 12 to 16 carbon atoms, the higher fatty alcohol is of 12 to 18 carbon atoms and the polyethoxy is of 3 to 15 ethoxy groups, in 12 to 25 parts of a condensation product of ethylene oxide and higher fatty alcohol, in which nonionic detergent the fatty alcohol moiety averages 10 to 16 carbon atoms and the polyethoxy moiety averages 3 to 10 moles of ethylene oxide per mole, with the proportion of such anionic detergent to such nonionic detergent being in the range of 1:5 to 1:3, at a temperature in the range of 30° to 40° C., spraying such anionic detergent-nonionic detergent solution onto spray dried porous builder beads, by which they are absorbed, and applying to such anionic detergent-nonionic detergent-builder beads particulate fabric softening cationic compound, which adheres to and coats such beads.

20. A process according to claim 19 wherein the aqueous crutcher mix is of 50 to 75% solids content, which solids comprise sodium tripolyphosphate and sodium silicate, with the weight of the tripolyphosphate being from 5 to 20 times the weight of the silicate, or comprise sodium carbonate, sodium bicarbonate and zeolite builders, with the weight of sodium carbonate being from 0.7 to 1.5 times the weight of zeolite (anhydrous basis) and the weight of sodium bicarbonate being from 0.3 to 0.7 times the weight of sodium carbonate (spray dried bead basis), the spray dried beads are of particle sizes in the range of No's. 10 to 100, U.S. Sieve Series, the nonionic detergent is a higher fatty alcohol polyethoxylate wherein the higher fatty alcohol averages 12 to 15 carbon atoms per molecule and the polyethoxy moiety averages 6 to 7 moles per mole, the anionic detergent is triethanolamine linear dodecylbenzene sulfonate, the temperature of the liquid detergent is about 32° C., the liquid detergent comprises about 4 parts of said anionic detergent, about 16 parts of said nonionic detergent and about 2.7 parts of water, and the fabric softening cationic compound is distearyl dimethyl ammonium chloride, which is applied to the particulate anionic detergent-nonionic detergent-builder beads in a powder, which powder comprises about 8.5% of such cationic fabric softening compound, about 0.8% of higher fatty alcohol polyethoxylate emulsifying agent, and about 0.1% of hydrated synthetic calcium silicate, as a flow aid.

21. A method of washing and softening laundry which comprises adding to wash water, at a temperature in the range of 15° to 70° C., in an automatic washing machine, an article according to claim 1, and washing the laundry in such wash water, using a normal wash cycle for such washing machine.

22. A method according to claim 21 wherein the container of the article is a water insoluble, water permeable non-woven fabric pouch of synthetic organic polymeric fibers and the composition in such pouch comprises 8 to 40% of nonionic detergent, which is a condensation product of ethylene oxide and higher fatty alcohol in which the higher fatty alcohol averages 10 to 16 carbon atoms and the ethylene oxide content averages 3 to 10 moles of ethylene oxide per mole, 30 to 70% of builder, which is a mixture of sodium tripolyphosphate and sodium silicate, with the weight of the tripolyphosphate being 5 to 20 times the weight of the silicate, 0.5 to 15% of a fabric softening cationic compound which is a di-lower alkyl di-higher alkyl ammonium chloride wherein the lower alkyls are of 1 to 2 carbon atoms and the higher alkyls are of 12 to 20 carbon atoms, and 1 to 8% of anionic detergent, which is triethanolamine higher alkylbenzene sulfonate wherein the higher alkyl is of 12 to 14 carbon atoms.

23. A method according to claim 21 wherein the container of the article is a water insoluble, water permeable non-woven fabric pouch of synthetic organic polymeric fibers and the composition in such pouch comprises 8 to 40% of nonionic detergent, which is a condensation product of ethylene oxide and higher fatty alcohol in which the higher fatty alcohol averages 10 to 16 carbon atoms and the ethylene oxide content averages 3 to 10 moles of ethylene oxide per mole, 30 to 70% of builder, which is a mixture of sodium carbonate, sodium bicarbonate and hydrated zeolite, with the weight of sodium carbonate being 0.7 to 1.5 times the weight of zeolite (anhydrous basis) and the weight of sodium bicarbonate being from 0.3 to 0.7 times the weight of sodium carbonate, 0.5 to 15% of a fabric softening cationic compound which is a di-lower alkyl di-higher alkyl ammonium chloride wherein the lower alkyls are of 1 to 2 carbon atoms and the higher alkyls are of 12 to 20 carbon atoms, and 1 to 8% of anionic detergent, which is triethanolamine higher alkylbenzene sulfonate wherein the higher alkyl is of 12 to 14 carbon atoms.

* * * * *